US007583226B2

(12) United States Patent
Sakurada

(10) Patent No.: US 7,583,226 B2
(45) Date of Patent: Sep. 1, 2009

(54) DIELECTRIC ANTENNA

(75) Inventor: Kiyoyasu Sakurada, Moriyama (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 602 days.

(21) Appl. No.: 10/585,672

(22) PCT Filed: Feb. 17, 2005

(86) PCT No.: PCT/JP2005/002392

§ 371 (c)(1),
(2), (4) Date: Jul. 7, 2006

(87) PCT Pub. No.: WO2005/081363

PCT Pub. Date: Sep. 1, 2005

(65) Prior Publication Data

US 2009/0021443 A1 Jan. 22, 2009

(30) Foreign Application Priority Data

Feb. 25, 2004 (JP) ..... 2004-049515

(51) Int. Cl.
*H01Q 1/38* (2006.01)

(52) U.S. Cl. ..... 343/700 MS; 343/702

(58) Field of Classification Search ..... 343/700 MS, 343/702, 911 R

See application file for complete search history.

(56) References Cited

U.S. PATENT DOCUMENTS 6,542,124 B1 * 4/2003 Yoon ..... 343/700 MS
6,759,990 B2 * 7/2004 Rossman ..... 343/700 MS
6,876,328 B2 * 4/2005 Adachi et al. ..... 343/700 MS
2003/0011533 A1 1/2003 Sakurada et al.

FOREIGN PATENT DOCUMENTS

| | | |
|---|---|---|
| JP | 01-114015 | 2/1989 |
| JP | 2000-133045 | 5/2000 |
| JP | 2000-215732 | 8/2000 |
| JP | 2000-286623 | 10/2000 |
| JP | 2003-147211 | 5/2003 |
| WO | WO-97/32314 | 9/1997 |
| WO | WO-97/32356 | 9/1997 |

OTHER PUBLICATIONS

International Search Report PCT/JP2005/002392 dated Apr. 4, 2005.
Written Opinion PCT/JP2005/002392 dated Apr. 4, 2005.
Japanese Office Action dated Apr. 26, 2005 (with English translation).

* cited by examiner

*Primary Examiner*—Hoang V Nguyen
(74) *Attorney, Agent, or Firm*—Dickstein Shapiro LLP

(57) ABSTRACT

A dielectric antenna is provided which uses a compounded material and exhibits a small change in relative dielectric constant at room temperature against a load due to temperature changes. The dielectric antenna includes a dielectric block, a radiation electrode, a feeding electrode and a fixing electrode provided on the dielectric block. The dielectric block contains a crystalline thermoplastic resin, ceramic powder, and an acid-modified styrenic thermoplastic elastomer. The acid-modified styrenic thermoplastic elastomer content in the dielectric block is 3% to 20% by volume.

12 Claims, 1 Drawing Sheet

DIELECTRIC ANTENNA

FIELD OF THE INVENTION

The present invention relates to dielectric antennas mainly used for cellular phones.

BACKGROUND OF THE INVENTION

Compounded materials prepared by blending ceramic powder with a resin are widely used for dielectric antennas. For example, Patent Document 1 has disclosed a compounded material containing a syndiotactic polystyrene and a dielectric ceramic for dielectric antennas. This document teaches that this compounded material provides a dielectric composite suitable for dielectric antennas, having superior electrical characteristics, workability and formability, and a low specific gravity.

Patent Document 1: Japanese Unexamined Patent Application Publication No. 11-345518

However, it has been known that if the known compounded material of patent Document 1 is used for dielectric antennas, the molding of the compounded material is varied in thickness at room temperature by repetitive changes in ambient temperature and that accordingly the relative dielectric constant ($\in_r$) of the molding is varied. The changes in relative dielectric constant of the material significantly affect the characteristics of the dielectric antenna.

SUMMARY OF THE INVENTION

Accordingly, an object of the present invention is to provide a dielectric antenna using a compounded material exhibiting a small change in relative dielectric constant at room temperature against a load due to temperature changes.

The dielectric antenna of the present invention at least includes a dielectric block, and a radiation electrode, a feeding electrode and a fixing electrode that are provided to the dielectric block. The dielectric block contains: at least one crystalline thermoplastic resin selected from the group consisting of polypropylenes, polyethylenes, polyethylene terephthalates, polybutylene terephthalates, and polyacetals; ceramic powder; and an acid-modified styrenic thermoplastic elastomer. The acid-modified styrenic thermoplastic elastomer content in the dielectric block is 3% to 20% by volume.

According to the dielectric antenna of the present invention, the component dielectric block contains a compounded material containing a crystalline thermoplastic resin and ceramic powder, and a predetermined amount of acid-modified styrenic thermoplastic elastomer. The dielectric block exhibits a small change in relative dielectric constant against a load due to temperature changes. Accordingly, the dielectric antenna can exhibit stable antenna characteristics against the load due to temperature changes.

REFERENCE NUMERALS

Figure 1:
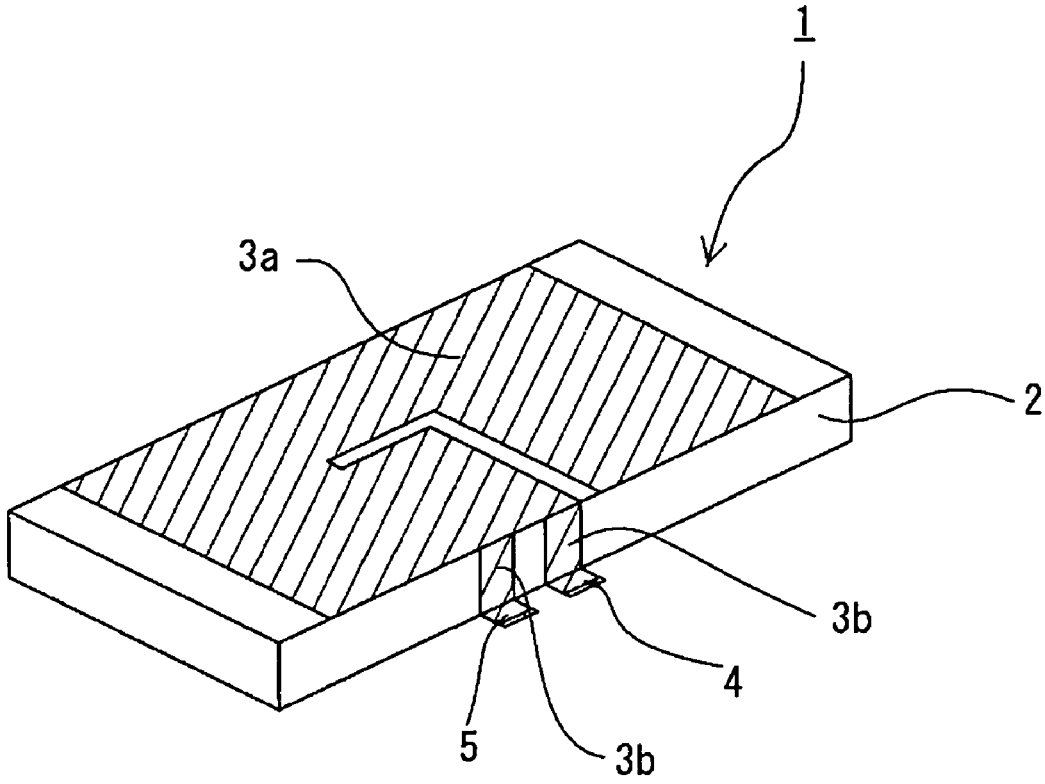
FIG. 1 is a perspective view of a dielectric antenna according to the present invention.

1: dielectric antenna
2: dielectric block
3 (3*a*, 3*b*): radiation electrodes
4: feeding electrode
5: fixing electrode

DETAILED DESCRIPTION OF THE INVENTION

A dielectric antenna according to an embodiment of the present invention will now be described.

FIG. 1 is a perspective view of a dielectric antenna of the present invention.

The dielectric antenna 1 of the present invention includes a dielectric block 2, radiation electrodes 3 (3*a*, 3*b*), a feeding electrode 4, and a fixing electrode 5.

A radiation electrode 3*a* is formed on one of the principal surfaces of the dielectric block 2. Two radiation electrodes are formed on the side surfaces of the dielectric block 2, and respectively connected to the feeding electrode 4 and the fixing electrode 5.

The dielectric block 2 is formed in a rectangular shape by injection molding, and the other of the principal surfaces is open. This structure results in weight reduction by eliminating unnecessary portions of the molding of the compounded dielectric material, but the dielectric block is not limited to this form. For example, the dielectric block may be in a flat plate form as shown in FIG. 1, or in a disc form. It also may be a stack of a plurality of flat plates.

Preferably, the radiation electrodes 3, the feeding electrode 4 and the fixing electrode 5 are formed by insert molding or outsert molding in order to reduce cost and the number of process steps. Since the resonance frequency of the dielectric block 2 is adjusted by varying the shape of the radiation electrodes 3, the shapes and arrangement of the radiation electrodes 3, the feeding electrode 4 and the fixing electrode 5 are appropriately adjusted. The radiation electrodes 3, the feeding electrode 4 and the fixing electrode 5 can be made of Au, Ag, Cu, or their alloy. From the viewpoint of costs, Cu or its alloy is generally used. Form the viewpoint of stability with time, electrodes with a multilayer plating may be used as the radiation electrode 3, the feeding electrode 4 and the fixing electrode 5.

In the dielectric antenna 1 having the above-described structure, high-frequency power is applied to the radiation electrodes 3 through the feeding electrode 4. Consequently, a high-frequency magnetic field is generated and radio waves are transmitted. The radiation electrodes 3 induce a high-frequency current and transmit the high-frequency current to an RF circuit when they receive radio waves. The use of the above-described dielectric block in the dielectric antenna 1 reduces the changes in relative dielectric constant caused by the load due to temperature changes, and the resulting dielectric antenna exhibits stable antenna characteristics.

An embodiment of the dielectric antenna of the present invention will now be described.

The radiation electrodes 3, the feeding electrode 4 and the fixing electrode 5 are formed by stamping a previously prepared metal foil into a predetermined shape. Then, the resulting metal member defining the radiation electrodes 3, the feeding electrode 4 and the fixing electrode 5 is placed in a predetermined mold. Subsequently, the compounded material used for the dielectric antenna of the present invention, melted by heating, is injected into the mold to form the dielectric block 2 with the radiation electrodes 3, the feeding electrode 4 and the fixing electrode 5 in one piece. Thus, the desired dielectric antenna 1 is completed.

In the above-described embodiment, the dielectric block 2, the radiation electrodes 3, the feeding electrode 4 and the fixing electrode 5 are integrally formed by molding the dielectric block 2 with the previously prepared radiation electrodes 3, feeding electrode 4 and fixing electrode 5. However, the dielectric block 2 may be previously formed and then the radiation electrodes 3, the feeding electrode 4 and the fixing electrode 5 are conformed to the shape of the dielectric block 2 so that they are integrated. The radiation electrodes 3, the feeding electrode 4 and the fixing electrode 5 may be formed by plating, sputtering, vapor deposition, or the like.

again in the rocking mixer for 30 minutes to yield the compounded dielectric block material for each of intended samples 1 to 8.

Although the continuous twin screw extruder was used in the example, other mixing apparatuses, such as batch kneaders, may be used for mixing the materials and they can produce the same effect as in the present invention. Although the dried melted mixture was crushed into pellets with a crusher, the pellets may be prepared by use of other machines, such as a pelletizer or a hot cutter in the present invention.

TABLE 1

| | | Content (vol %) | | | | | | | Rate of | |
|---|---|---|---|---|---|---|---|---|---|---|
| | Sample No. | Polypropylene resin | maleic acid-modified SEBS | acid-unmodified SEBS | Alumina | Calcium titanate | Glass fibers | Thickness expansion (%) | change in relative dielectric constant (%) | Evaluation |
| | 1 | 50 | 10 | 0 | 19 | 14 | 7 | +0.30 | 0 | Good |
| | 2 | 55 | 5 | 0 | 19.5 | 13.5 | 7 | +0.60 | −0.3 | Good |
| | 3 | 56 | 3 | 0 | 19.5 | 13.5 | 8 | +0.96 | −1.2 | Good |
| | 4 | 41 | 20 | 0 | 19 | 14 | 6 | 0 | 0 | Good |
| * | 5 | 59 | 0 | 0 | 19.5 | 13.5 | 8 | +0.60 | −2.3 | Bad |
| * | 6 | 37 | 25 | 0 | 19 | 14 | 5 | 0 | 0 | Bad |
| * | 7 | 57 | 1 | 0 | 19.5 | 13.5 | 9 | +2.00 | −1.4 | Bad |
| * | 8 | 55 | 0 | 5 | 19.5 | 13.5 | 7 | +0.60 | −1.5 | Bad |

Examples of the present invention will now be described.

(1) Preparation of Compounded Material for Dielectric Block

First, for the compounded material of the dielectric block using an acid-modified styrenic thermoplastic elastomer, a polypropylene resin, a resin containing maleic acid-modified styrene-ethylene-butadiene block copolymer (abbreviated as maleic acid-modified SEBS), alumina powder, calcium titanate powder, and glass fibers were prepared as starting materials.

For the compounded material of the dielectric block using an acid-unmodified styrenic thermoplastic elastomer, a polypropylene resin, a resin containing styrene-ethylene-butadiene block copolymer (abbreviated as acid-unmodified SEBS), alumina powder, calcium titanate powder, and glass fibers were prepared as starting materials.

Although the present invention uses polypropylene as the crystalline thermoplastic resin, the crystalline thermoplastic resin may be, for example, polyethylene, syndiotactic polystyrene, polyethylene terephthalate, polybutylene terephthalate, liquid crystal polymer, polyphenylene sulfide, or polyacetal. These resins can also produce the same effect as in the present invention.

Although a maleic acid-modified styrenic thermoplastic elastomer was used as the acid-modified styrenic thermoplastic elastomer, any carboxylic acid-modified styrenic thermoplastic elastomer may be used such as acrylic acid-modified or methacrylic acid-modified styrenic thermoplastic elastomer. These acid-modified styrenic thermoplastic elastomers can also produce the same effect as in the present invention.

Then, the starting materials were compounded at the proportions shown in Table 1, and blended in a rocking mixer for 30 minutes. Subsequently, the mixture of the starting materials was placed in a continuous twin screw extruder and melt-kneaded with the temperature controlled at 190 to 210° C. The mixture was dried optionally in an oven and thus a dried melted mixture was prepared. The dried melted mixture was crushed into pellets with a crusher. The pellets were mixed (2) Preparation of Test Pieces for Characteristic Evaluation The compounded dielectric block materials of samples 1 to 8 prepared in (1) were each injected into a mold while being melted by heating to form a circular test piece of 55 mm in diameter by 1.3 mm in thickness for measurements of thickness expansion and rate of change in relative dielectric constant.

In the same manner, the compounded dielectric block materials of samples 1 to 8 were injection-molded in another mold to prepare test pieces in a desired plate form of 80 mm in length by 10 mm in width by 4 mm in thickness for flexural property test.

(3) Measurements of Circular Test Pieces for Thickness Expansion and Rate of Change in Relative Dielectric Constant A sequence of treatments before and after measurements was repeated 50 cycles in which the circular test piece prepared in (2) was allowed to stand in a test bath maintained at −40° C. in a thermal-shock test apparatus for 30 minutes, and further allowed to stand in another test bath maintained at 85° C. for 30 minutes.

In the measurement of the thickness expansion (%), first, before placing the circular test piece in the test apparatus, the thickness of the circular test piece was measured at 5 points around the center with a micrometer. The average of the measurements was defined as the thickness (μm) before standing. Then, after the 50 cycles of thermal-shock test, the thickness was measured at the same 5 points around the center. The average of the measurements was defined as the thickness (μm) after the 50-cycle thermal-shock test. Then, the thickness expansion (%) was calculated from the following Equation 1 using the thicknesses before standing and after the 50-cycle thermal-shock test:

$$\text{thickness expansion (\%)}=[(\text{thickness after 50-cycle thermal shock}-\text{thickness before standing})/\text{thickness before standing}]\times 100 \quad \text{Equation 1}$$

The relative dielectric constant ($\in_r$) of the circular test piece was measured with a network analyzer (apparatus name: HP8510 produced by Agilent technologies) before standing in the test apparatus and immediately after taking out from the test apparatus after the 50-cycle thermal shock test, and the rate (%) of change in relative dielectric constant was calculated from the following Equation 2.

rate (%) of change in relative dielectric constant= {(relative dielectric constant after 50-cycle thermal shock−relative dielectric constant before standing)/relative dielectric constant before standing]×100 Equation 2

(4) Measurements of Relative Dielectric Constant and Q Factor at 3 GHz and Mechanical Strength The relative dielectric constants ($\in_r$) and Q factors at 3 GHz of Samples 1 to 8 were measured. Then, the flexural strength (MPa), the modulus of elasticity in flexure (MPa), and the deflection (mm) at break were measured.

The relative dielectric constant ($\in_r$) and the Q factor of the circular test piece were measured with the network analyzer at a measurement frequency of 3 GHz.

The flexural strength (MPa), the flexural modulus (MPa), and the deflection (mm) at break were measured in accordance with "Plastics—Determination of flexural properties (JIS K 7171)" with a flexural test apparatus (apparatus name: Autograph manufactured by Shimadzu Corporation), with the test piece placed on a support in the apparatus. The testing speed was 2 mm/min and the span was 60 mm. The measurement results are shown in Table 2.

TABLE 2

| | Sample No. | Initial properties: Relative dielectric constant at 3 GHz | Q factor at 3 GHz | Flexural strength (MPa) | Flexural modulus (MPa) | Deflection at break (mm) | Evaluation |
|---|---|---|---|---|---|---|---|
| | 1 | 6.4 | 667 | 40.9 | 3240 | 4.3 | Good |
| | 2 | 6.4 | 667 | 46.9 | 4059 | 3.4 | Good |
| | 3 | 6.4 | 667 | 43.0 | 4500 | 3.0 | Good |
| | 4 | 6.4 | 500 | 35.0 | 3020 | 6.1 | Good |
| * | 5 | 6.5 | 611 | 39.0 | 6815 | 1.4 | Bad |
| * | 6 | 6.3 | 280 | 30.0 | 3000 | 8.2 | Bad |
| * | 7 | 6.4 | 667 | 42.0 | 4622 | 2.6 | Bad |
| * | 8 | 6.4 | 667 | 36.0 | 3788 | 1.4 | Bad |

In Tables 1 and 2, the samples marked with an asterisk * are outside the scope of the present invention and the others are inside the scope of the present invention.

As clearly shown in Table 1, the compounded dielectric block materials containing 3% to 20% by volume of maleic acid-modified SEBS (Samples 1 to 4) exhibited rates of change in relative dielectric constant within ±1.2%. Also, Samples 1 to 4 exhibited superior mechanical strengths, such as flexural strength.

In contrast, Sample 5, which is outside of the scope of the present invention, exhibited a rate of change in relative dielectric constant of larger than 1.2 in absolute value, as shown in Table 1. Sample 7 exhibited a thickness expansion as large as 2%, as shown in Table 1. In addition, Sample 6 exhibited a flexural strength as low as 30 MPa as shown in Table 2, although it has been considered from drop tests that the flexural strength needs to be at least 35 MPa. Sample 6 also exhibited a Q factor as low as less than 300 at 3 GHz. Sample 8, which used acid-unmodified styrenic thermoplastic elastomer, exhibited a rate of change in relative dielectric constant of larger than 1.2 in absolute value, as shown in Table 1.

The properties of samples 5 to 8 are not suitable as the compounded material of dielectric antennas used in cellular phones.

Although in the examples, glass fibers were added to the compounded dielectric block materials containing acid-modified SEBS of the present invention, glass fibers are not essential. However, glass fibers may be added to such an extent as not to affect the rate of change in relative dielectric constant, thereby enhancing the mechanical strength.

In addition, additives, such as an antioxidant, an antistatic agent, and a fire retardant, may be appropriately added to the compounded dielectric block material, as long as they do not affect the rate of change in relative dielectric constant.

The present invention can be suitably applied to antennas of, for example, cellar phones.

The invention claimed is:

1. A dielectric antenna comprising:

a dielectric block; and a radiation electrode, a feeding electrode and a fixing electrode provided on the dielectric block, wherein the dielectric block contains:

at least one crystalline thermoplastic resin selected from the group consisting of polypropylenes, polyethylenes, polyethylene terephthalates, polybutylene terephthalates, polyphenylene sulfides and polyacetals;

ceramic powder; and an acid-modified styrenic thermoplastic elastomer, and wherein the acid-modified styrenic thermoplastic elastomer content in the dielectric block is 3% to 20% by volume.

2. The dielectric antenna according to claim 1, wherein the crystalline thermoplastic resin is at least one resin selected from the group consisting of polypropylenes, polyethylenes, and polyacetals.

3. The dielectric antenna according to claim 1, wherein the crystalline thermoplastic resin is at least one resin selected from the group consisting of polypropylenes and polyethylenes.

4. The dielectric antenna according to claim 1, wherein the crystalline thermoplastic resin is polypropylene.

5. The dielectric antenna according to claim 1, wherein the acid-modified styrenic thermoplastic elastomer is a maleic acid-modified styrenic thermoplastic elastomer.

6. The dielectric antenna according to claim 1, wherein the acid-modified styrenic thermoplastic elastomer is a carboxylic acid-modified styrenic thermoplastic elastomer.

7. A dielectric block for a dielectric antenna, the dielectric block comprising:

at least one crystalline thermoplastic resin selected from the group consisting of polypropylenes, polyethylenes, polyethylene terephthalates, polybutylene terephthalates, polyphenylene sulfides and polyacetals;

ceramic powder; and an acid-modified styrenic thermoplastic elastomer, and wherein the acid-modified styrenic thermoplastic elastomer content in the dielectric block is 3% to 20% by volume.

8. The dielectric block according to claim 7, wherein the crystalline thermoplastic resin is at least one resin selected from the group consisting of polypropylenes, polyethylenes, and polyacetals.

9. The dielectric block according to claim 7, wherein the crystalline thermoplastic resin is at least one resin selected from the group consisting of polypropylenes and polyethylenes.

10. The dielectric block according to claim 7, wherein the crystalline thermoplastic resin is polypropylene.

11. The dielectric antenna according to claim 7, wherein the acid-modified styrenic thermoplastic elastomer is a maleic acid-modified styrenic thermoplastic elastomer.

12. The dielectric antenna according to claim 7, wherein the acid-modified styrenic thermoplastic elastomer is a carboxylic acid-modified styrenic thermoplastic elastomer.

* * * * *